United States Patent [19]

Schausberger et al.

[11] 4,189,803

[45] Feb. 26, 1980

[54] WET-PROCESSING APPARATUS FOR PHOTOGRAPHIC EMULSION CARRIERS WITH NOVEL DISPOSAL OF DRIER-UNIT EXHAUST AIR

[75] Inventors: Helmut Schausberger, Unterhaching; Erwin Geyken, Neubiberg; Peter Dawidowitsch, Münich, all of Fed. Rep. of Germany

[73] Assignee: AGFA-Gevaert, A.G., Leverkusen, Fed. Rep. of Germany

[21] Appl. No.: 930,537

[22] Filed: Aug. 1, 1978

[30] Foreign Application Priority Data

Aug. 4, 1977 [DE] Fed. Rep. of Germany ..... 2735085

[51] Int. Cl.[2] ..... G03D 3/13

[52] U.S. Cl. ..... 15/302; 15/306 A; 134/64 P; 134/122 P

[58] Field of Search ..... 15/302, 306 A, 306 B; 134/64 P, 122 P

[56] References Cited

U.S. PATENT DOCUMENTS

| | | | |
|---|---|---|---|
| 3,350,248 | 10/1967 | Demarest et al. | 15/302 X |
| 3,660,910 | 5/1972 | Evans et al. | 15/302 X |
| 3,849,831 | 11/1974 | DeVerter et al. | 15/302 |
| 4,045,839 | 9/1977 | Parsonage | 15/302 |

*Primary Examiner*—Christopher, K. Moore

*Attorney, Agent, or Firm*—Michael J. Striker

[57] ABSTRACT

The apparatus includes a washing unit at which film is washed with wash water, including a wash-water tank containing a body of wash water, and also a drier unit from which drying air is continually exhausted. Exhausted drying air from the drier unit is transmitted into the body of wash water in the wash-water tank. Alternatively, or in addition thereto, exhausted drying air is transmitted into the outflow conduit system for spent wash water. The wash water becomes oxygen-enriched and when sewered the oxygen demand of any processing fluids in the wash water poses a reduced threat to lifeforms in rivers and streams. Disposal of exhausted drying air in this way eliminates the need for chimney discharge, and the like.

7 Claims, 3 Drawing Figures

WET-PROCESSING APPARATUS FOR PHOTOGRAPHIC EMULSION CARRIERS WITH NOVEL DISPOSAL OF DRIER-UNIT EXHAUST AIR

BACKGROUND OF THE INVENTION

The invention relates to apparatus for the wet processing of photographic emulsion carriers, of the type including a wash-water tank and also a drier, within which latter the emulsion carrier is contacted by warm air.

With apparatus of the type in question, it is well known to discharge the exhaust air from the drier via a chimney or the like into the ambient atmosphere. It has also been proposed that, to make use of the heat energy of the exhaust air from the drier, such exhaust air be passed through a heat exchanger serving to preheat the fresh water continually needed for the washing unit of the apparatus. The exhaust air leaving the heat exchanger is then, likewise, discharged to atmosphere via a chimney. In either case, means must be provided for conveying exhaust air from the drier away from the apparatus without discharging such air into the room in which the processing apparatus is situated. Also, when such apparatus is provided with a chimney for discharge of the drier-unit air, the installation tends to become rather noisy during operation.

SUMMARY OF THE INVENTION

It is the general object of the invention to provide a processing apparatus of the type in question which, however, does not require exterior exhaust air discharge such as described above.

In accordance with the invention, this is achieved by feeding the exhaust air from the drier of the processing apparatus into the discharge conduit for spent wash water and/or into the wash-water tank itself.

The invention makes possible a simplification in the installation of this type of photographic processing apparatus; connection to an exhaust air discharge system, such as a chimney system, becomes unnecessary; likewise release of heat to ambient interior air, resulting from transmission of drier-unit exhaust air through long conduits leading to a chimney or the like, is avoided. Lately, the trend in x-ray technology is in the direction towards operating film processing apparatus in spaces illuminated by daylight, and this has tended to result in the combining of exposure-taking equipment and developing equipment into a single apparatus. This in turn requires that the developing apparatus operate with low noise and without release of large amounts of very wet air. The inventive technique for disposing of the exhaust air from the drier unit is particularly well suited to such applications.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
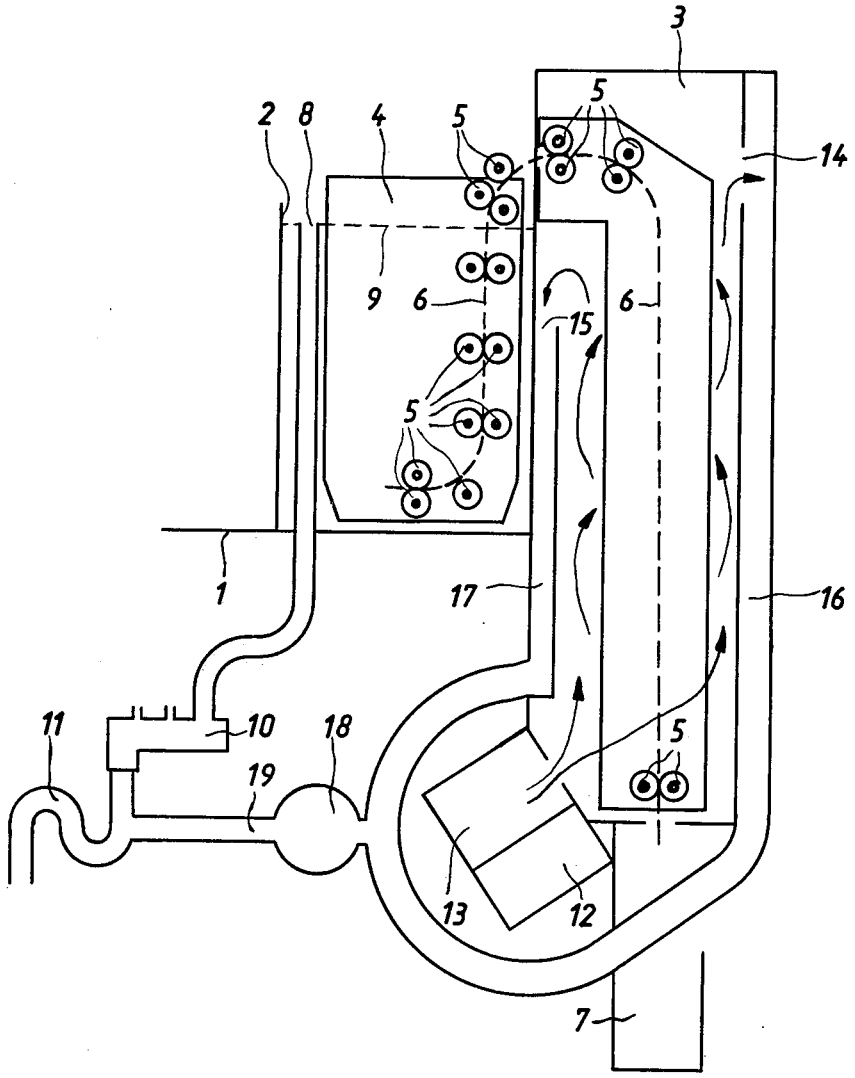
FIGS. 1-3 depict three different exemplary embodiments of the invention.

In FIG. 1, numeral 1 denotes the frame of an apparatus for the wet processing of a photographic emulsion carrier, here by way of example a developing apparatus for x-ray film. Of such apparatus, the only major units depicted in the drawing are a wash-water tank 2 and a drier 3. Located in the wash-water tank 2 is a rack 4 on which are mounted transport rollers 5, of which only some are actually depicted. Further transport rollers 5 are likewise provided within the drier unit 3, the transport rollers defining a transport path 6 (shown in broken lines) for the emulsion carrier. Located beneath the drier 3 is a collecting bin 7 into which the sheets of emulsion carrier drop after being processed.

Located in wash-water tank 2 is a spillover conduit 8, by means of which the upper level 9 of wash water in tank 2 is maintained constant. Spent wash water flows through spillover conduit 8 into a collecting or buffer tank 10 for waste fluid. A syphon 11 connects the tank 10 to a waste water discharge system, e.g., leading into a body of water, into a municipal sewer system, or the like.

At its lower part, the drier 3 comprises a blower 12 and a heater 13, by means of which there is established a flow of heated air which is passed through the drier 3 in the direction opposite to the transport direction of the film being dried. At the upper part of drier 3, to either side of the film transport path 6, there are provided air discharge openings 14 and 15, which feed into two conduits 16 and 17. The conduits 16 and 17 feed to a blower 18 which, via a line 19, feeds into the syphon 11.

The apparatus depicted in FIG. 1 operates as follows:

During operation of the apparatus, exhaust air leaves the upper part of drier 3 through the air discharge openings 14, 15 and is sucked through conduits 16, 17 by the blower 18 and forced via line 19 into syphon 11. The spent water from the wash-water tank 2 is likewise continually fed to syphon 11, via spillover conduit 8 and waste-fluid collecting or buffer tank 10. Just upstream of, or alternatively within, syphon 11 the spent water is vigorously mixed with the exhaust air from the drier, resulting in enrichment of the spent water with oxygen. The thusly oxygen-enriched waste water makes for a quicker than otherwise occurring decrease in the biologically harmful oxygen demand of any developer or fixer fluid which the processed photographic film may have dragged into wash-water tank 2 from processing units located further upstream along transport path 6. One of the major environmental threats posed by developer and fixer fluids used to develop photographic film is their oxygen demand. When such fluids ultimately reach natural bodies of water, due to their oxygen demand, they divert oxygen from living organisms, for example threatening the survival of various fish species, and the like. The inventive oxygen-enrichment of the spent wash water, besides constituting a particularly simple way of disposing of the exhausted drier-unit air, provides the spent wash water with higher than ordinary oxygen content, so that when such water eventually reaches a natural body of water, considerably less oxygen will be stolen from the life systems of lifeforms present in such bodies of water. Often, the collecting or buffer tank 10 will also be connected to receive spent developer and fixer fluids. In that event, the oxygen enrichment of the discharged fluids resulting when the inventive drier-unit exhaust air disposal technique is employed, likewise decreases the threat posed by oxygen demand of photographic fluids. It will be understood that, for example, the spillover conduit 8, and any other conduits feeding into tank 10, can be provided with one-way check valves, to preclude flow of the drier-unit exhaust air up through such conduits, and to ensure that all such exhaust air is forced through syphon 11, i.e., if the construction of the buffer tank 10 does not already ensure this.

Figure 2:
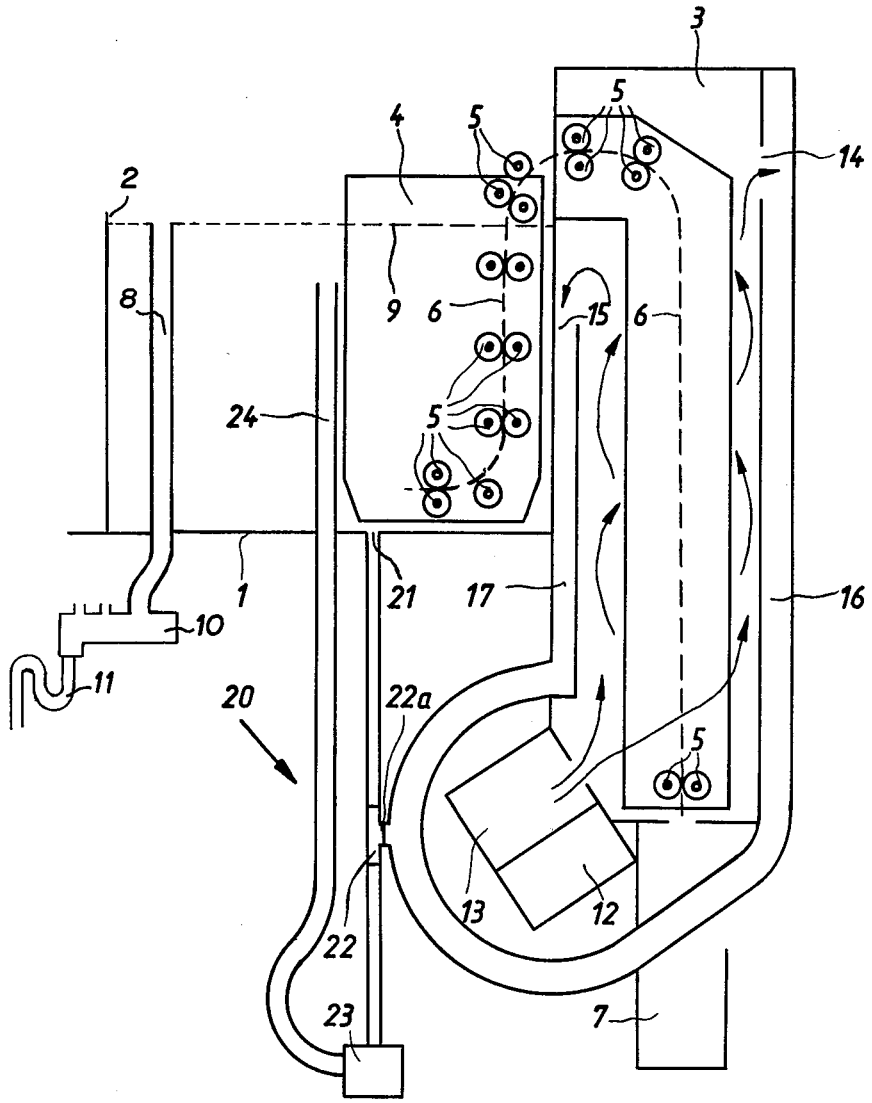

FIG. 2 is a view similar to FIG. 1, but with the part of the apparatus shown in FIG. 1 here differently modified; in part, the same reference numerals are used to denote components the same as in FIG. 1. In the modification shown here, the exhaust air from the drier unit is not fed into the discharge conduit for spent wash water, but instead is fed into the body of wash water in wash-water tank 2. For this purpose, a recirculation pumping system 20 is connected to the tank 2. The recirculation pumping system 20 mainly comprises a water outflow conduit 21 opening at the bottom of tank 2, a water jet pump 22, a recirculation pump 23 and an inflow conduit 24. The water jet pump 22 is connected at its suction port 22*a* to the exhaust air conduits 16, 17 of the drier unit 3. A water jet pump is a pump having a water inlet port and a water outlet port; as water is driven through the water jet pump, there is produced at the suction port of the pump a suction force capable of pulling into the main flow of water the exhaust air from conduits 16, 17.

The structure shown in FIG. 2 operates as follows:

The recirculation pump 23 sucks water out of the bottom of tank 2 via conduit 22, draws such water through the water jet pump 22 and then pumps this water up through inlet conduit 24 for return into the body of water in wash-water tank 2. As wash water from tank 2 is thusly pulled through water jet pump 22, the suction generated at suction port 22*a* sucks in the drier-unit exhaust air from exhaust air conduits 16, 17. As a result, the water returned into the tank 2 is thoroughly mixed with exhaust air and accordingly oxygen-enriched. In this way, the exhaust air from the drier unit is safely and conveniently disposed of, and the oxygen-enriched wash water, when it ultimately is sewered, will once again present a considerably reduced threat to lifeforms. Additionally, this method of disposing of the drier-unit exhaust air serves to temper the wash water in tank 2, making it possible to dispense with preheating of fresh or replenishing wash water and to dispense with the earlier mentioned heat exchanger.

Figure 3:
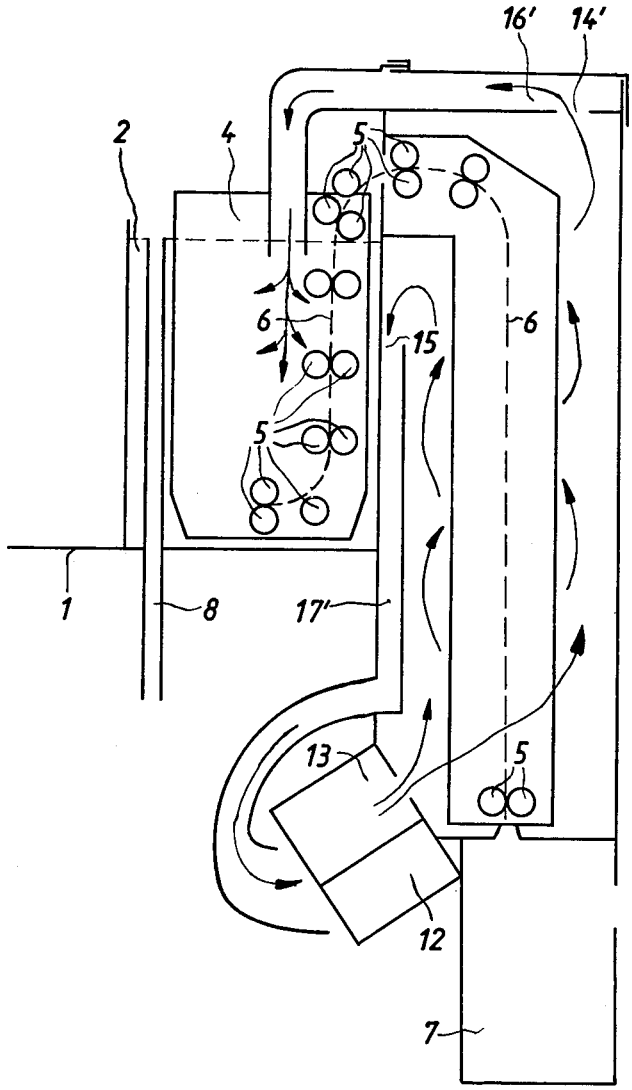

FIG. 3 depicts a simpler version of the modified apparatus shown in FIG. 2. The hot air passing to the top end of the drier 3 passes in part into outlet opening 15 and in part into an outlet opening 14' at the top of the drier unit. From outlet opening 15, the exhaust air passes via a conduit 17' to the suction side of the blower 12, for recirculation purposes, so as to make possible some saving in the amount of heat energy needed for drying by partial reuse of already heated drying air. The exhaust air emerging from outlet opening 14' passes via a conduit 16' directly into the body of water in wash-water tank 2, the lower end of conduit 16' opening into the body of water at a level below the upper surface of the body of water in tank 2. Accordingly, the exhaust air leaving drier 3 and passing through outlet opening 14' and conduit 16' is forced into the body of water in tank 2, which serves once again to agitate the wash water and to temper it, as well as to at least partly nullify the environmentally objectionable character of the drier-unit exhaust air.

In the embodiments shown in FIGS. 2 and 3 the wash-water tank 2 is depicted as an open tank. However, it will be understood that tank 2 can, in these embodiments, be a covered tank, to prevent the drier-unit exhaust air forced into the wash water in tank 2 from freely escaping through the open top of the tank, in applications where that might be undesirable; if a covered or closed tank 2 is employed, the exhaust air forced into the tank will be able to leave the tank only through the water discharge conduit (not shown in FIGS. 2 and 3) through which spent wash water is discharged for sewering.

In the exemplary embodiments of the invention described above, there is the additional advantage that the drying action to which the photographic emulsion carrier is subjected is improved, because the moist and hot air exhausted from the drier is for the most part (FIG. 3) continually replaced by fresh drying air or continually replaced by fresh drying air exclusively (FIGS. 1 and 2). Accordingly, each sheet of film transported through the drier is presented with substantially identical, unvarying drying conditions, i.e., with respect to air circulation, air moisture and air temperature, making for a very uniform drying action both on a short- and long-term basis. This is in comparison to drying procedures wherein a limited volume of drying air is used for a protracted period resulting in gradual decrease of drying effectiveness. The circulation of water employed in FIG. 2, and the agitation of water resulting from the forcing-in of drier-unit exhaust air in FIG. 3, make for improved washing of the sheets of emulsion carrier transported through the washing tank 2, and therefore improve the quality of the final product.

In FIG. 1, the drier-unit exhaust air is exclusively delivered into the syphon 11 for spent wash water, and none of the exhaust air is fed into the body of water in the wash tank 2; however, a combination of both such techniques could be used in FIG. 1, and also in FIGS. 2 and 3.

It will be understood that each of the elements described above, or two or more together, may also find a useful application in other types of constructions differing from the types described above.

While the invention has been illustrated and described as embodied in photographic-film developing apparatus of particular type, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An improved apparatus for the wet-processing of photographic emulsion-carrying material, the apparatus being of the type comprising a washing unit at which photographic emulsion-carrying material is washed with wash water, the washing unit including a wash-water tank containing a body of wash water and an outflow conduit system communicating with the wash-water tank for continual withdrawal of spent wash water from the wash-water tank, the wash water in the wash-water tank being wash water at a first location and the wash water in the outflow conduit system being wash water at a second location, and a drier unit in which photographic emulsion-carrying material is dried, the drier unit including means for contacting photographic emulsion-carrying material with heated drying air and for exhausting used drying air from the drier unit, the improvement comprising:

exhaust-air transmitting means receiving the exhausted drying air from the drier unit and transmitting the exhausted drying air into at least one of said locations.

2. The apparatus defined in claim 1, the outflow conduit system including an outflow conduit and a syphon, the outflow conduit receiving spent wash water from the wash-water tank and transmitting such water to the syphon for subsequent discharge, the exhaust-air transmitting means comprising a blower and at least one exhaust-air conduit, the exhaust-air conduit receiving exhausted drying air from the drier unit and transmitting such air to the suction side of the blower, the blower blowing the exhausted drying air into the syphon.

3. The apparatus defined in claim 2, the outflow conduit system furthermore including a collecting tank connected intermediate the outflow conduit and the syphon, the collecting tank receiving the spent wash water continually withdrawn from the wash-water tank, the collecting tank furthermore having inlets connected to receive spent processing fluid from other processing units of the apparatus.

4. The apparatus defined in claim 1, the washing unit including wash-water recirculating means for continually withdrawing wash water from the wash-water tank and continually returning the thusly withdrawn wash water back into the wash-water tank, the exhaust-air transmitting means including at least one exhaust-air conduit receiving exhausted drying air from the drier unit and transmitting such air into the wash water passing through the wash-water recirculating means.

5. The apparatus defined in claim 4, the wash-water recirculating means including a water-withdrawal conduit connected for withdrawal of wash water from the wash-water tank, a water-return conduit connected to return withdrawn wash water into the wash-water tank, a recirculation pump connected to the water-withdrawal and water-return conduits for causing wash water withdrawn through the former to be returned through the latter into the tank, and a water jet pump connected in one of said conduits of the recirculating means, the water jet pump having a suction port at which is developed a suction force upon passage of water through the water jet pump, the at least one exhaust-air conduit being connected to transmit the exhausted drying air into the suction port of the water jet pump.

6. The apparatus defined in claim 1, the exhaust-air transmitting means comprising means receiving the exhausted drying air from the drier unit and transmitting part of the exhausted drying air directly into the body of wash water in the wash-water tank.

7. The apparatus defined in claim 6, the last-mentioned means including an exhaust-air discharge conduit extending below the upper surface of the body of wash water in the wash-water tank, the drier unit furthermore including heating means for heating air and transmitting thusly heated air into the drier unit, the exhaust-air transmitting means furthermore including means receiving another part of the exhausted drying air and returning it to the heating means.

* * * * *